United States Patent [19]

Napier

[11] 4,288,013

[45] Sep. 8, 1981

[54] JAR CARRIER HAVING U-SHAPED JAR RETAINERS

[76] Inventor: David Napier, Roark, Ky. 40979

[21] Appl. No.: 77,106

[22] Filed: Sep. 19, 1979

[51] Int. Cl.[3] ..... B65D 71/00; A47B 73/00

[52] U.S. Cl. ..... 294/87.2; 206/145; 206/159; 211/74; 294/162

[58] Field of Search ..... 224/45 A, 45 AA; 206/139, 145, 159, 160, 199, 201; 211/74, 75, 77; 294/87.2, 87.22

[56] References Cited

U.S. PATENT DOCUMENTS

| | | | |
|---|---|---|---|
| 773,366 | 10/1904 | Bennett | 224/45 AA |
| 1,482,799 | 2/1924 | Korhummel | 211/74 |
| 1,719,360 | 7/1929 | Deike | 224/45 AA |
| 2,028,694 | 1/1936 | Spinks | 224/45 AA |
| 2,301,594 | 11/1942 | Voigtritter | 294/87.2 |
| 2,432,700 | 12/1947 | Ulbrich | 294/87.22 |
| 2,461,317 | 2/1949 | Dreher | 224/45 AA |
| 4,037,766 | 7/1977 | Iacono | 224/45 AA |

FOREIGN PATENT DOCUMENTS

| | | | |
|---|---|---|---|
| 920518 | 11/1954 | Fed. Rep. of Germany | 211/74 |

*Primary Examiner*—Stephen Marcus

*Attorney, Agent, or Firm*—Woodard, Weikart, Emhardt & Naughton

[57] ABSTRACT

A jar carrier including a frame, legs extending downwardly therefrom, a pair of handles secured to the top of the frame, a plurality of lipped, U-shaped openings defined by the frame for reception of jars therein, and U-shaped retaining members pivotally mounted at each of the openings to pivot downwardly and retain jars within the openings.

4 Claims, 3 Drawing Figures

JAR CARRIER HAVING U-SHAPED JAR RETAINERS

BACKGROUND OF THE INVENTION

1. Field of the Invention

The present invention relates to the field of portable carriers, and particularly to a jar carrier.

2. Description of the Prior Art

Portable bottle carriers have been known in the prior art. In U.S. Pat. No. 2,616,751, issued to Goldenberg on Nov. 4, 1952, there is disclosed a bottle holder and carrier. The Goldenberg device comprises a molded frame having openings along one side for reception of bottles, and a handle extending upwardly therefrom. No means for closing the openings is provided to retain the bottles in the openings. A similar device is disclosed in U.S. Pat. No. 2,508,945, issued to Heuer on May 23, 1950. The Heuer device also includes openings along one side, and does not provide means for closing off these openings to retain the bottles therein. In U.S. Pat. No. 3,552,612, issued to Greis on Jan. 5, 1971, there is disclosed a carrier structure which includes openings on opposite sides of a handle and tabs at the end of the openings to help to retain the bottles therein.

Stationary bottle carriers are disclosed in U.S. Pat. Nos. 2,772,787, issued to Lee on Dec. 4, 1956, and 2,128,114 issued to Benedetti on Aug. 23, 1938. Both of these patents show a bottle holder for mounting to a wall or other support, which holder includes a hook member which pivots from one side of the opening to close the opening and retain the bottles therein.

SUMMARY OF THE INVENTION

A portable jar carrier in one aspect comprises a generally rectangular, horizontal frame having a top, a bottom and two opposed sides, the frame defining a first plurality of generally U-shaped openings along each of the opposed sides, the frame further defining a second plurality of generally U-shaped openings along each of the opposed sides, each of the second plurality of openings being smaller and aligned with one of the first plurality of openings, the first and second plurality of openings thereby defining a plurality of lipped openings for reception and support of jars therein. Legs are mounted to the frame and extend downwardly therefrom. Handle means are secured to the frame, and retaining means are mounted to the frame for retaining a jar within each of the plurality of U-shaped openings, the retaining means including a generally U-shaped member associated with each of the plurality of openings and being pivotable from an open position to a closed position in which the U-shaped member engages the jar.

It is an object of the present invention to provide a jar carrier which is simple and durable in construction.

It is another object of the present invention to provide a jar carrier which is easy to use and which is well balanced during use.

A further object of the present invention is to provide a jar carrier which includes a simple and reliable means for retaining the jars in the carrier.

Further objects and advantages of the present invention will become apparent from the description of the preferred embodiment which follows.

DESCRIPTION OF THE PREFERRED EMBODIMENT

Figure 3:
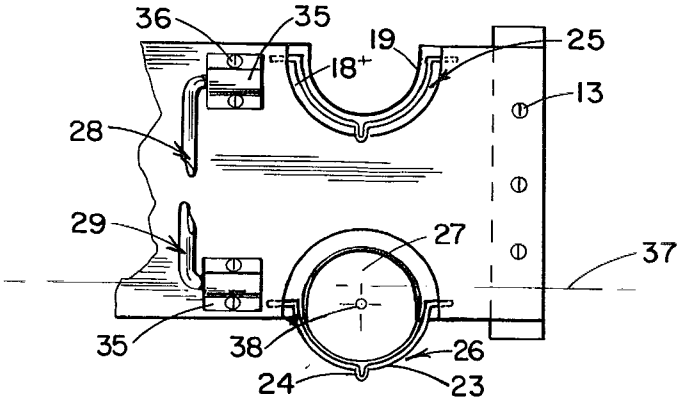
FIG. 3 is partial, top plan view of the jar carrier of FIG. 1.
Figure 2:
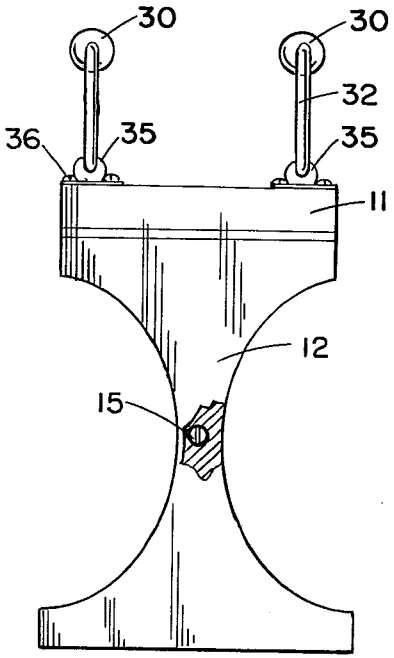
FIG. 2 is an end view of the jar carrier of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to the drawings, there is shown a jar carrier 10 constructed in accordance with the present invention. Jar carrier 10 includes a frame 11 mounted upon a pair of legs 12 with screws 13. A cross brace 14 extends between and is secured to the legs 12 by screws 15.

The legs 12 have a top portion which spans the width of the frame 11. The bottom portion of the legs 12 are wider than the frame 11 by between one-half inch and one inch on each side, preferably by about three fourths of an inch. The bottom of the legs is made wider than the top to make the jar carrier more stable. In particular, the wider bottom makes it more difficult for the jar carrier to tip over when it is set down on a surface.

Figure 1:
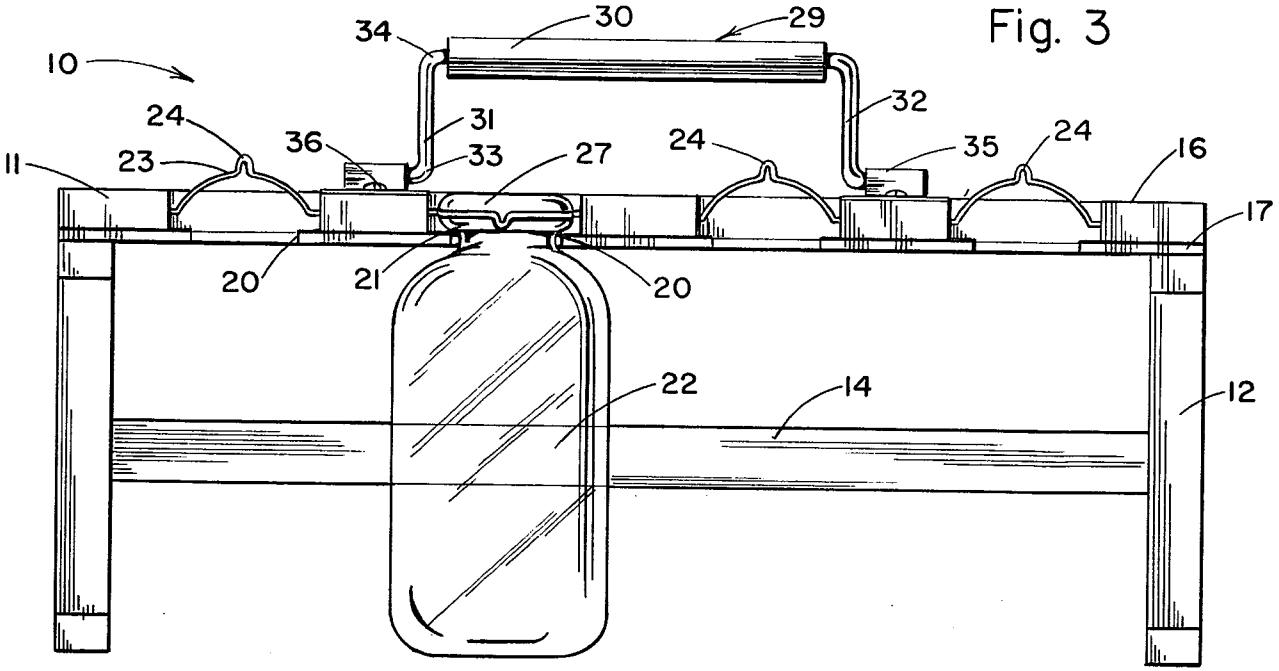
FIG. 1 is a front, elevational view of a jar carrier constructed in accordance with the present invention.

Frame 11 comprises a first member 16 and a second member 17. The first member defines several outwardly-facing U-shaped openings, such as 18, for reception of the top of a jar therein. Corresponding with each of the openings 18 is a slightly smaller U-shaped opening 19 defined by the second member 17. Second member 17 thereby provides a series of lips 20 within which the neck of a jar is received and upon which the jar lip 21 rests. In FIG. 1, for example, jar 22 is shown positioned within the openings in members 16 and 17, with the lip 21 resting upon a lip 20 provided by second member 17.

For each of the openings in the frame, there is provided a wire retainer having a generally semi circular shape and a gripping portion 24. The ends of the wire retainer 23 are received in apertures in the first member 16 located on opposite sides of each of the openings in the first member. The wire retainers 23 are mounted for pivoting about these ends to move the wire retainer from a first position 25 to a second position 26. As shown in the figures, in the first position of the wire retainer the openings in the first and second members are unobstructed and a jar may be slid into position in the openings. Once in position, the wire retainer is moved into the second position 26 and is received about and engages the lid 27. The wire retainer frictionally engages the jar lid and thereby retains the jar in the associated openings in the first and second members. When access to a jar is desired, the wire retainer is simply rotated back to its first position and the jar may be slid from the openings.

A pair of handles 28 and 29 are mounted to the top of frame 11. Each of the handles includes a central gripping portion 30 and connecting members 31 and 32 which are pivotally secured to the frame. The connecting members 31 and 32 preferably comprise length of rod or tubing which are bent at the locations such as 33 and 34 for connection with the frame and the gripping portion of the handle. The ends of the connecting members are received within retaining members such as 35 which are secured to the first member 16 of frame 11 by screws, such as 36. As shown particularly in FIG. 3, each of the handles is secured to the frame 11 inwardly of the center of gravity of the jars as they are retained in the frame openings. For example, handle 29 is secured to frame 11 at retaining member 35 (FIG. 3) at a location 37 which is positioned inwardly of the center 38 of the jar. A particular feature of this location for mounting is that the jar carrier of the present invention is particularly adapted for use when jars are retained on only one side of the frame. When jars are retained on both sides of the frame, the two handles are used together to carry the jar carrier in balance. However, when jars are retained only along one side, the handle located on that side may be used by itself to permit the jar carrier to be carried without substantial unbalance. The handles are mounted to the frame slightly inward of the center of the jars such that the weight of the jar carrier will assist in balancing the combined load of the jars and jar carrier when jars are retained only along one side.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A portable jar carrier which comprises:

a generally rectangular, horizontal frame having a top, a bottom and two opposed sides, said frame defining a first plurality of generally U-shaped openings along each of the opposed sides, said frame further defining a second plurality of generally U-shaped openings along each of the opposed sides, each of said second plurality of openings being smaller and aligned with one of the first plurality of openings, the first and second plurality of openings thereby defining a plurality of lipped openings for reception and support of jars therein;

legs mounted to said frame and extending downwardly therefrom;

handle means secured to said frame; and retaining means mounted to said frame for retaining a jar within each of the plurality of U-shaped openings, said retaining means including each of the openings having a separate, generally U-shaped member pivotally mounted to said frame, each of the U-shaped members having end portions received in apertures in said frame located on opposite sides of the respective U-shaped opening, each of the retaining members being pivotable about the end portions from an open position to a closed position in which the U-shaped member engages the jar, whereby each U-shaped opening may be individually opened or closed.

2. The jar carrier of claim 1 in which said handle means comprises a pair of handles, the handles being located at opposite sides of said frame.

3. The jar carrier of claim 2 in which each of the pair of handles is mounted to the frame inwardly of the centers of the U-shaped openings.

4. The jar carrier of claim 3 in which each of the legs includes a bottom portion which is wider than said frame.

* * * * *